US012648623B2

(12) United States Patent
Frank et al.

(10) Patent No.: US 12,648,623 B2
(45) Date of Patent: Jun. 9, 2026

(54) SOLE STRUCTURE FOR ARTICLE OF FOOTWEAR

(71) Applicant: NIKE, Inc., Beaverton, OR (US)

(72) Inventors: Nicholas S. Frank, Portland, OR (US); Gjermund Haugbro, Beaverton, OR (US); Stephan Hausmann, Happy Valley, OR (US); Fiona L. Lesecq, Beaverton, OR (US); Michele Tosello, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/743,472

(22) Filed: Jun. 14, 2024

(65) Prior Publication Data

US 2024/0415237 A1 Dec. 19, 2024

Related U.S. Application Data

(60) Provisional application No. 63/508,464, filed on Jun. 15, 2023.

(51) Int. Cl.
*A43C 15/16* (2006.01)
*A43C 15/02* (2006.01)

(52) U.S. Cl.
CPC ..... *A43C 15/162* (2013.01); *A43C 15/02* (2013.01)

(58) Field of Classification Search
CPC ..... A43B 13/223; A43C 15/162
See application file for complete search history.

(56) References Cited

U.S. PATENT DOCUMENTS

| | | | | |
|---|---|---|---|---|
| 6,016,613 | A * | 1/2000 | Campbell | A43B 5/001 D2/906 |
| 6,973,746 | B2 * | 12/2005 | Auger | A43B 1/0072 36/67 A |
| 10,104,938 | B2 * | 10/2018 | Auger | A43B 13/26 |
| D854,803 | S * | 7/2019 | de Montgolfier | D2/962 |
| D980,605 | S * | 3/2023 | Remy | D2/962 |
| 2009/0100716 | A1 * | 4/2009 | Gerber | A43B 5/02 36/114 |
| 2013/0047465 | A1 | 2/2013 | Auger et al. | |
| 2013/0067778 | A1 * | 3/2013 | Minami | A43C 15/16 36/59 R |
| 2013/0139412 | A1 * | 6/2013 | Auger | A43B 13/184 36/25 R |
| 2014/0026441 | A1 | 1/2014 | Stauffer | |
| 2016/0366984 | A1 | 12/2016 | Minami | |
| 2017/0238654 | A1 * | 8/2017 | Baghdadi | A43B 13/141 |
| 2022/0079296 | A1 * | 3/2022 | Chua | A43C 15/161 |

OTHER PUBLICATIONS

European Patent Office (ISA), International Search Report and Written Opinion for PCT App. No. PCT/US2024/034233, mailed Sep. 26, 2024.

* cited by examiner

*Primary Examiner* — Ted Kavanaugh
(74) *Attorney, Agent, or Firm* — Honigman LLP; Matthew H. Szalach; Jonathan P. O'Brien

(57) ABSTRACT

A sole structure for an article of footwear includes a first conical traction element disposed in a forefoot region of the sole structure. The sole structure also includes a first elongate traction element, a second elongate traction element, and a third elongate traction element arranged in a radial pattern around the first conical traction element within the forefoot region.

20 Claims, 13 Drawing Sheets

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/508,464, filed on Jun. 15, 2023. The disclosure of this prior application is considered part of the disclosure of this application and is hereby incorporated by reference in its entirety.

FIELD

The present disclosure relates generally to an article of footwear and more particularly to a sole structure for an article of footwear

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement including a midsole and an outsole extending between a ground surface and the upper. The outsole may include a baseplate formed of a rigid or semi-rigid material that provides rigidity and energy distribution across the sole structure. The baseplate may be provided with one or more ground-engaging members for engagement with a ground surface.

BRIEF DESCRIPTION OF DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
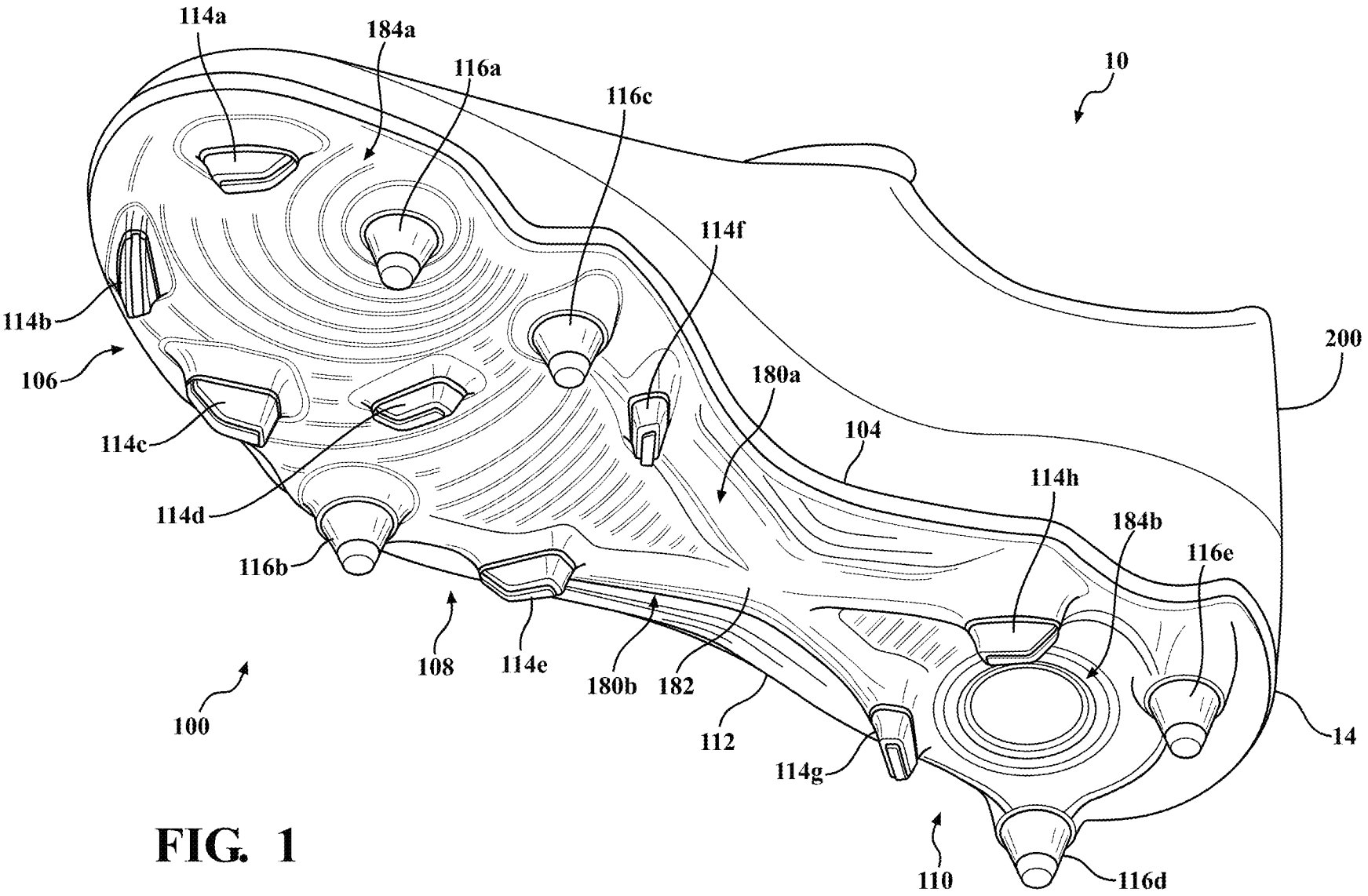
FIG. 1 is a medial side perspective view of an example of an article of footwear according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

An aspect of the disclosure provides a sole structure for an article of footwear. The sole structure includes a first conical traction element disposed in a forefoot region of the sole structure. The sole structure also includes a first elongate traction element, a second elongate traction element, and a third elongate traction element arranged in a radial pattern around the first conical traction element within the forefoot region.

Aspects of the disclosure may include one or more of the following optional features. In some implementations, the first conical traction element may be frustoconical. In some examples, each of the first elongate traction element, the second elongate traction element, and the third elongate traction element may include a trailing end that tapers down to a leading end. The second elongate traction element may be disposed between the first elongate traction element and the third elongate traction element. The leading end of the second elongate traction element may oppose the trailing end of the first elongate traction element and the trailing end of the second elongate traction element may oppose the leading end of the third elongate traction element.

In some configurations, at least one of the first elongate traction element, the second elongate traction element, and the third elongate traction element may be disposed a different distance from the first conical traction element than the others of the first elongate traction element, the second elongate traction element, and the third elongate traction element. Optionally, the first conical traction element may be disposed adjacent to a medial side of the sole structure. A second conical traction element may be disposed adjacent to the medial side of the sole structure and between the first conical traction element and a posterior end of the sole structure. One of the first elongate traction element, the second elongate traction element, and the third elongate traction element may be aligned with the second conical traction element. In some examples, the second conical traction element may be disposed closer to a posterior end of the sole structure than the one of the first elongate traction element, the second elongate traction element, and the third elongate traction element. In some implementations, an article of footwear incorporates the sole structure.

Another aspect of the disclosure provides a sole structure for an article of footwear. The sole structure includes a first conical traction element disposed in a heel region of the sole structure and adjacent to a medial side of the sole structure. A second conical traction element is disposed in the heel region of the sole structure and adjacent to a lateral side of the sole structure. The sole structure also includes a first elongate traction element disposed in the heel region of the sole structure and proximate to the medial side of the sole structure. A second elongate traction element is disposed in the heel region of the sole structure and is proximate to the lateral side of the sole structure. The first conical traction element, the second conical traction element, the first elongate traction element, and the second elongate traction element are disposed in a radial pattern.

Aspects of the disclosure may include one or more of the following optional features. In some examples at least one of the first conical traction element and the second conical traction element may be frustoconical. In some configurations, each of the first elongate traction element and the second elongate traction element may include a trailing end that tapers down to a leading end. The leading end of the first elongate traction element may oppose the first conical traction element. The leading end of the second elongate traction element may oppose the second conical traction element. Optionally, the trailing end of the first elongate traction element may oppose the trailing end of the second elongate traction element. In some configurations, the sole structure may include a plate that may define a ground-engaging surface of the sole structure. At least a portion of the first conical traction element, the second conical traction element, the first elongate traction element, and the second elongate traction element may be integrally formed with the plate. In some examples, an article of footwear may incorporate the sole structure.

Figure 2:
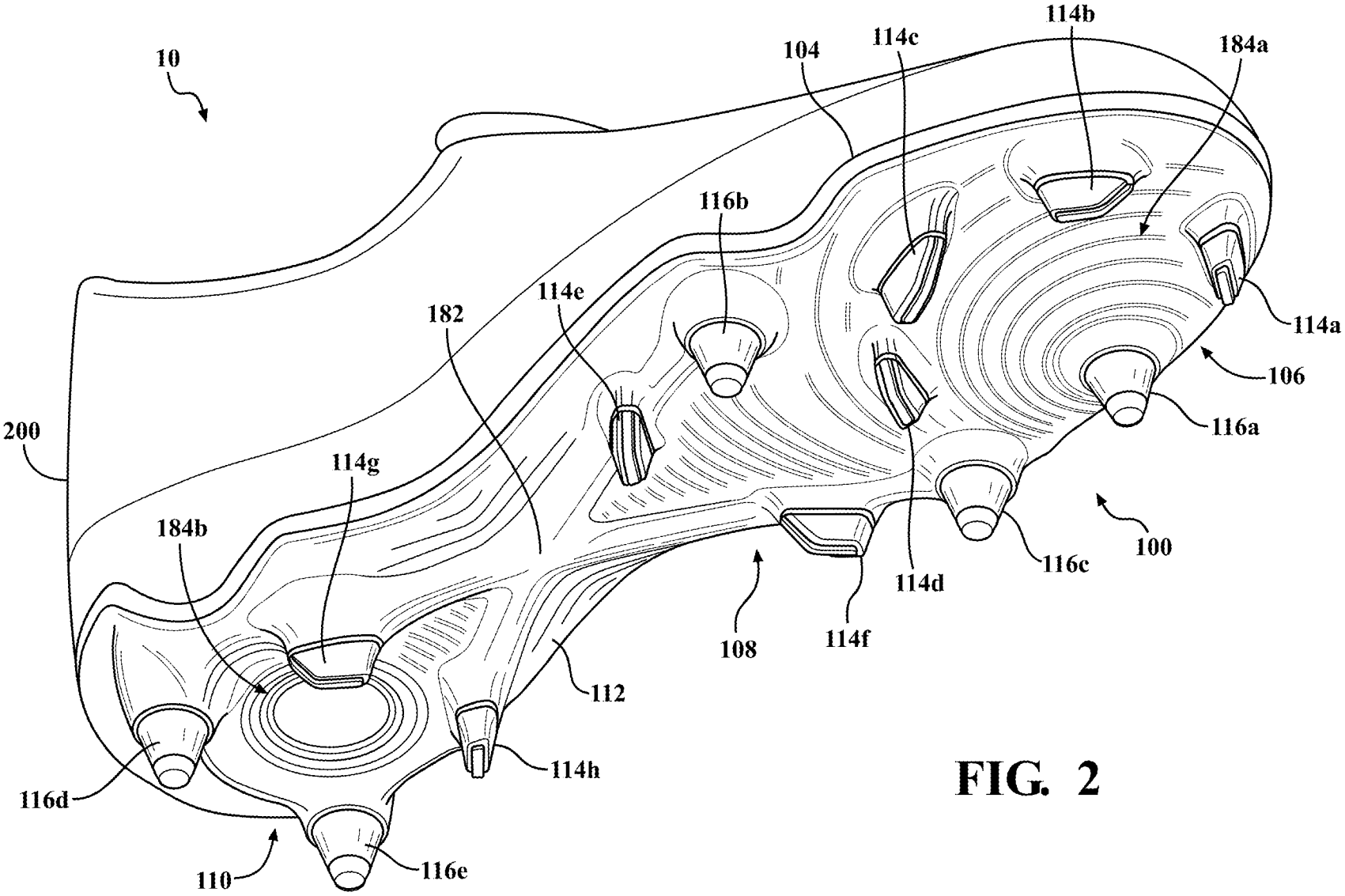
FIG. 2 is a lateral side perspective view of the article of footwear of FIG. 1.
Figure 3:
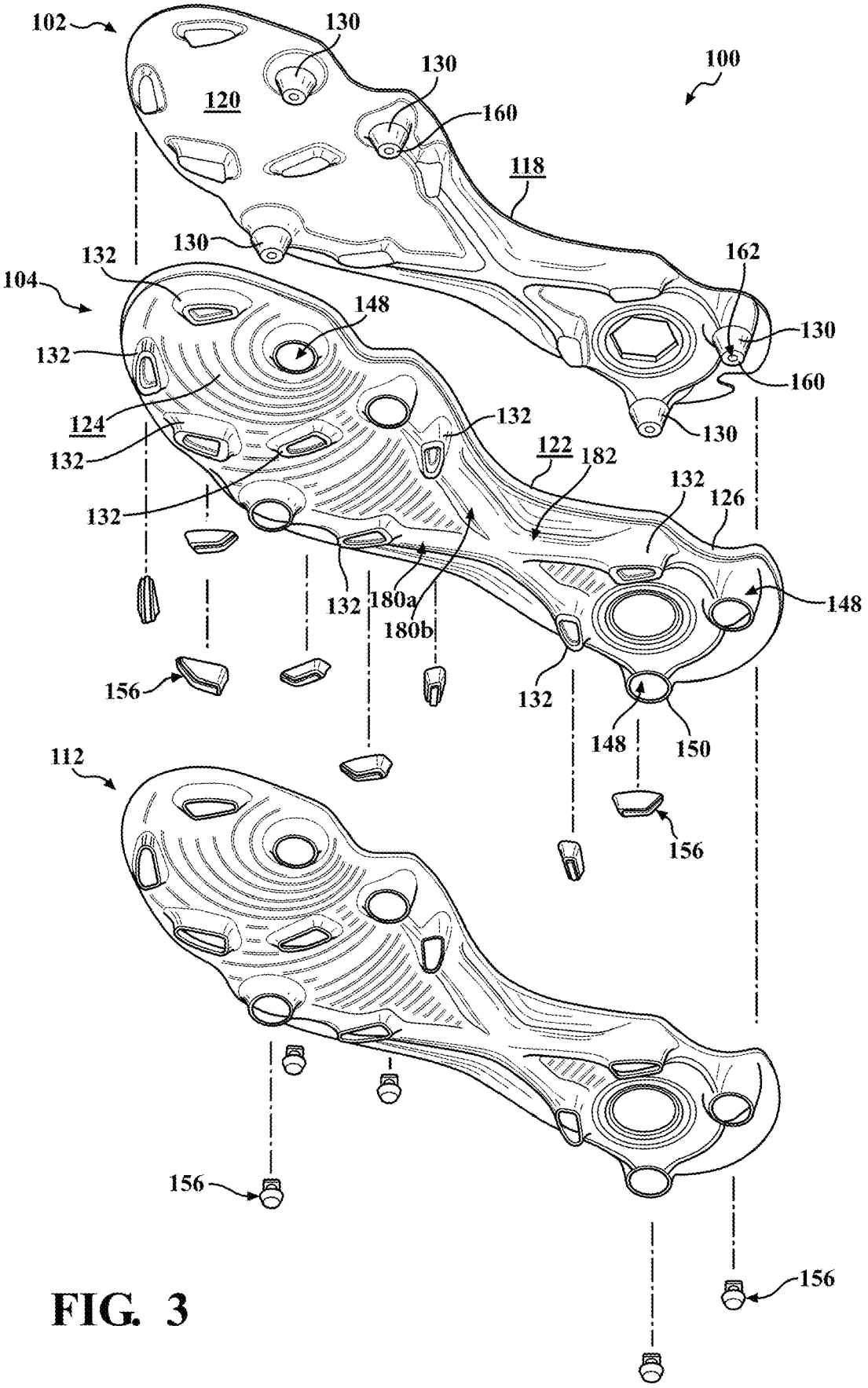
FIG. 3 is an exploded perspective view of the article of footwear of FIG. 1.

Referring to FIGS. 1-3, an article of footwear 10 includes a sole structure 100 and an upper 200 attached to the sole structure 100. The article of footwear 10 may further include an anterior end 12 associated with a forward-most point of the footwear 10 and a posterior end 14 corresponding to a rearward-most point of the footwear 10. A longitudinal axis $A_{10}$ (FIG. 4B) of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may include a toe portion 20 corresponding with the phalanges of a foot and a ball portion 20B associated with an anterior portion of the metatarsal bones of the foot. The mid-foot region 22 may correspond with an arch area of the foot, and the heel region 24 may correspond with rear portions of the foot, including a calcaneus bone.

The upper 200 includes interior surfaces that define an interior void configured to receive and secure a foot for support on the sole structure 100. The upper 200 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort. In some examples, one or more fasteners (not shown) extend along the upper 200 to adjust a fit of the interior void around the foot and to accommodate entry and removal of the foot therefrom. The upper 200 may include apertures such as eyelets and/or other engagement features such as fabric or mesh loops that receive the fasteners. The fasteners may include laces, straps, cords, hook-and-loop, or any other suitable type of fastener. The upper 200 may include a tongue portion (not shown) that extends between the interior void and the fasteners.

Referring to FIGS. 1-3, the sole structure 100 of the illustrated example includes a first or primary sole plate 102, a secondary sole plate 104 attached to a bottom surface of the primary sole plate 102, a forefoot cleat set 106 disposed in the forefoot region 20, a mid-foot cleat set 108 disposed in the mid-foot region 22, and a heel cleat set 110 disposed in the heel region 24. Optionally, the sole structure 100 incudes a film layer 112 extending along a length of the secondary sole plate 104 that resists dirt and other debris from adhering to the sole structure 100. As discussed in greater detail below, the cleat sets 106, 108, 110 each incorporate a respective group of traction elements 114*a*-114*h*, 116*a*-116*e*.

The primary sole plate 102 extends from the anterior end 12 of the sole structure 100 to the posterior end 14 and may be described as including an upper or interior side 118 and a lower or exterior side 120 formed on an opposite side from the interior side 118. Thus, the interior side 118 generally corresponds to a footbed of the article of footwear 10. The secondary sole plate 104 is attached to the lower side 120 of the primary sole plate 102 at an interior surface 122 of the secondary sole plate 104.

The secondary sole plate 104 includes an exterior surface 124 that corresponds to a ground-engaging surface of the article of footwear 10. A distance from the interior side 118 to the exterior side 120 of the primary sole plate 102 defines a thickness of the primary sole plate 102, and a distance from the interior surface 122 of the secondary sole plate 104 to the exterior surface 124 defines a thickness of the secondary sole plate 104. The interior surface 122 and the exterior surface 124 are connected to each other by a peripheral edge 126 that extends along the periphery of the secondary sole plate 104. Thus, the peripheral edge 126 defines a peripheral profile of the secondary sole plate 104. It is also contemplated that the interior side 118 and the exterior side 120 are connected to each other by a similar peripheral edge that extends along the periphery of the primary sole plate 102. The peripheral edge 126 of the secondary sole plate 104 may extend above the peripheral edge of the primary sole plate 102, such that the primary sole plate 102 is encapsulated by the secondary sole plate 104.

Figure 5:
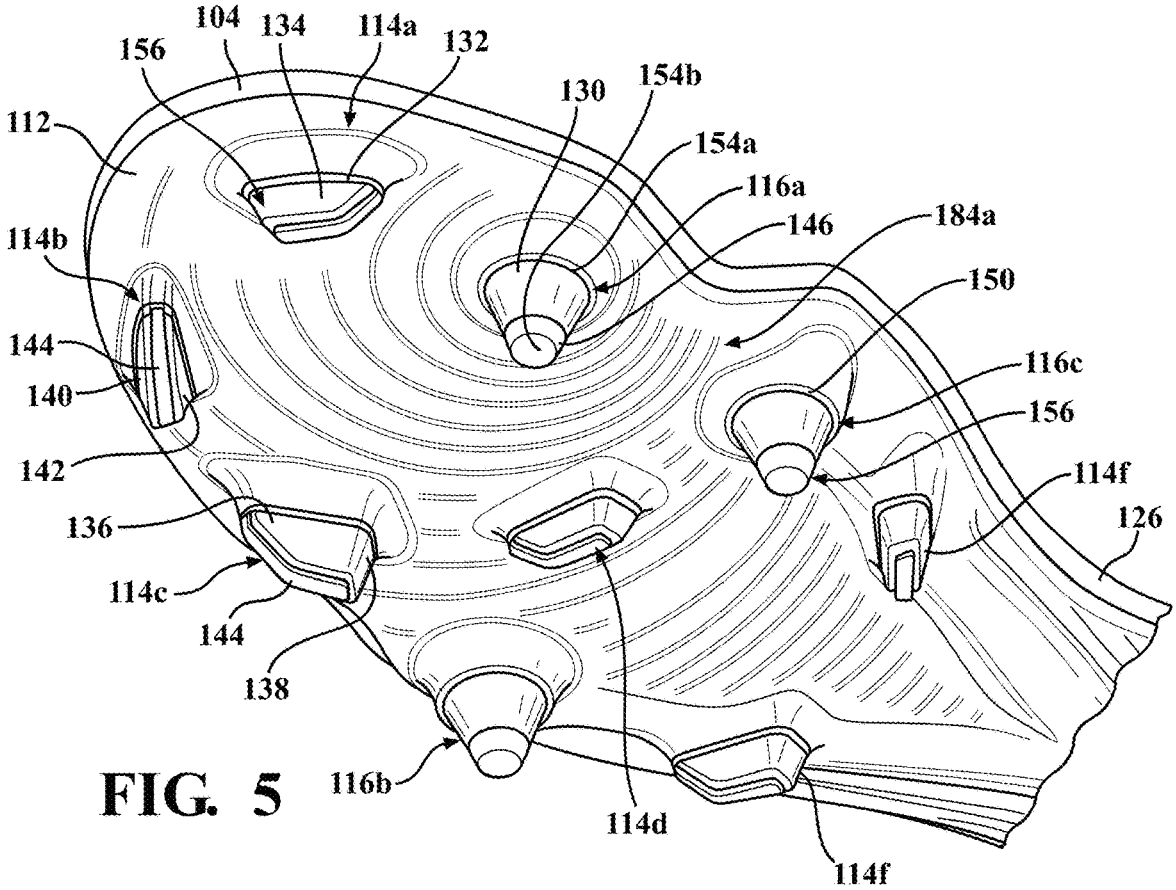
FIG. 5 is a partial perspective view showing a forefoot region of the sole structure of FIG. 1.
Figure 6:
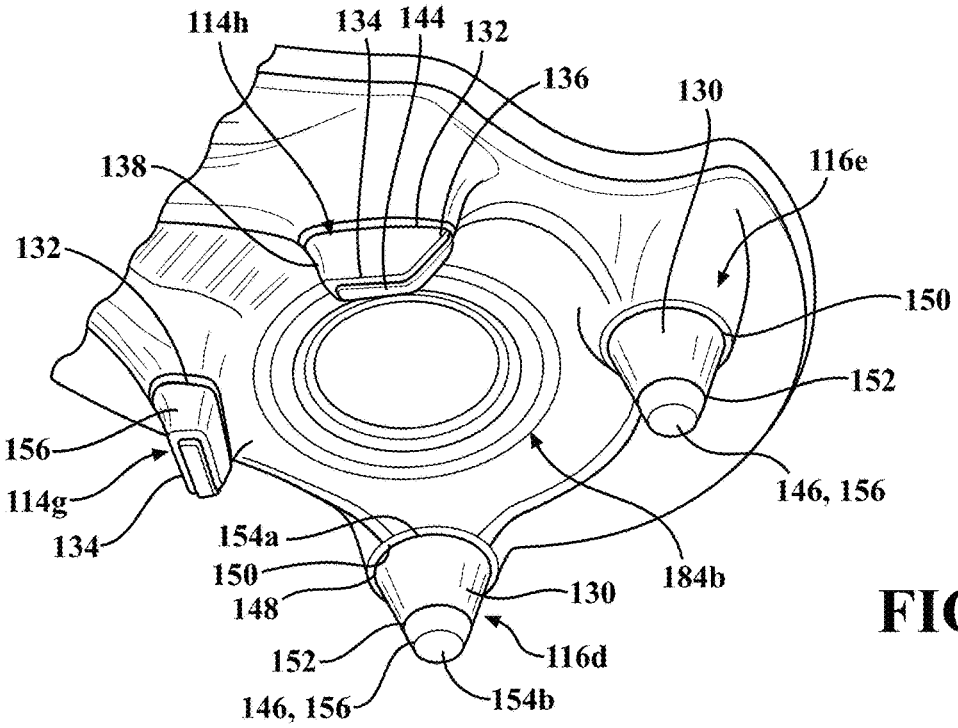
FIG. 6 is a partial side perspective view of a heel region of the sole structure of FIG. 1.
Figure 7:
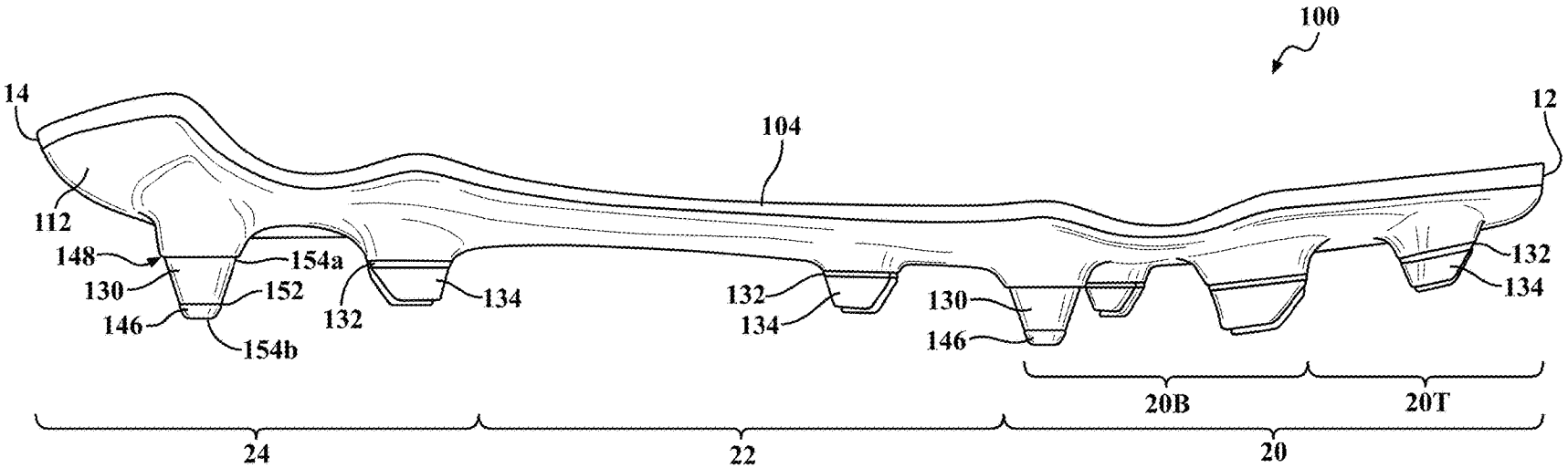
FIG. 7 is a lateral side elevation view of the sole structure of FIG. 1.

As illustrated in FIG. 5, the traction elements 114*a*-114*h* are formed by each of the primary sole plate 102 and the secondary sole plate 104. Specifically, each of the primary sole plate 102 and the secondary sole plate 104 includes a series of projections that, when nested together, cooperate to define a portion of the traction elements 114*a*-114*h*. The projections of the primary sole plate 102 and the projections of the secondary sole plate 104 include a similar geometry such that when the projections of the primary sole plate 102 are received by the projections of the secondary sole plate 104, the projections are in contact with one another to define the traction elements 114*a*-114*h*. Placing the projections in contact with one another allows the projections to reinforce one another, thereby enhancing the durability and strength of the traction elements 114*a*-114*h*. As shown in the drawings, the projections of the primary sole plate 102 and the secondary sole plate 104 and, thus, the traction elements 114*a*-114*h* formed by the projections, are so-called "blade" traction elements having a substantially elongate profile.

The traction elements 116*a*-116*e* are mainly defined by the primary sole plate 102, and include a substantially frustoconical shape. Namely, frustoconical-shaped projections of the primary sole plate 102 extend through respective openings formed in the secondary sole plate 104 to define the traction elements 116*a*-116*e*. While the traction elements 116*a*-116*e* are described as being primarily formed by the projections of the primary sole plate 102, the apertures of the secondary sole plate 104 that receive the respective projections of the primary sole plate 102 include a base extending in a direction away from the secondary sole plate 104. Each base defines a respective aperture through which a frustoconical projection of the primary sole plate 102 extends. The bases of the secondary sole plate 104 help reinforce the projections of the primary sole plate 102, thereby increasing the strength and durability of each traction element 116*a*-116*e*.

Figure 4A:
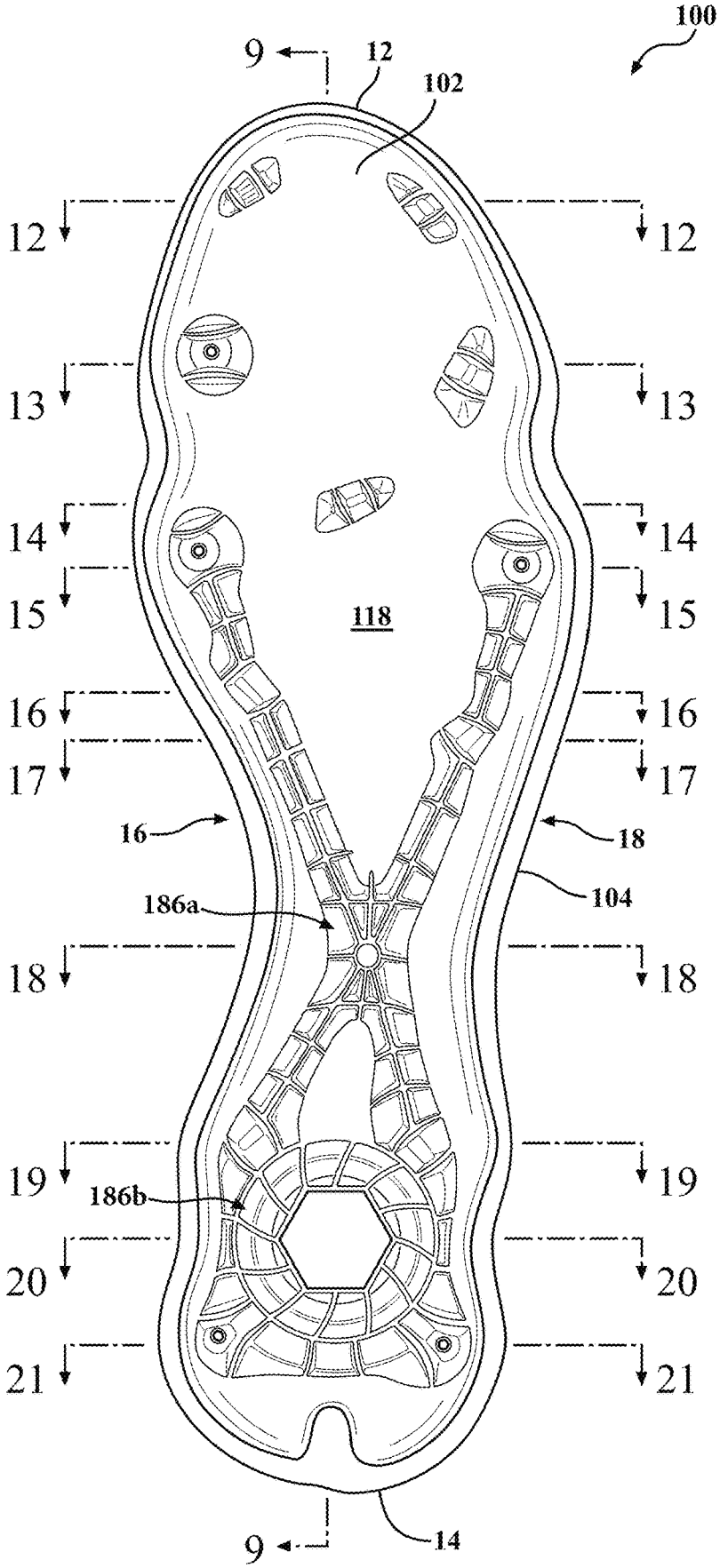
FIG. 4A is a top plan view of an example of a sole structure of the article of footwear of FIG. 1.

Referring to FIGS. 4A-5, in the illustrated example, each of the traction elements 114*a*-114*h* includes a substantially similar construction and is provided on the exterior surface 124 of the secondary sole plate 104 at different positions and orientations. For example, each of the traction elements 114*a*-114*h* has an elongate construction and a height that extends from the base portion 132 to a distal tip portion 134 formed at an opposite end of the traction elements 114*a*-114*h* than the base portion 132. As shown, the base portion 132 is formed by the exterior surface 124 of the secondary sole plate 104 and the distal tip portion 134 is formed separately from the base portion 132 and faces away from the exterior surface 124. A length of each of the traction elements 114*a*-114*h* extends from a leading end 136 to a trailing end 138 formed at an opposite end from the leading end 136. A width of each of the traction elements 114*a*-114*h* is defined between a first side 140 that extends from the leading end 136 to the trailing end 138 on the first side 140 and a second side 142 that extends from the leading end 136 to the trailing end 138 on an opposite side from the first side 140. As shown, one or more of the traction elements 114*a*-114*h* includes a traction rib 144 extending along the leading end 136 and the tip portion 134 of the traction element 114*a*-114*h*. The traction rib 144 may be formed as a continuous rib having a width that is less than the respective widths of the leading end 136 and the tip portion 134 and may protrude from the traction elements 114*a*-114*h* at the leading end 136 and the tip portion 134. Thus, the traction rib 144 and the tip portion 134 may define a step configuration at the distal end of the traction elements 114*a*-114*h* to enhance engagement of the traction elements 114*a*-114*h* with a ground surface.

With continued reference to FIGS. 4A-5, each traction element 114*a*-114*h* includes tapering geometries that facilitate penetration of the traction elements 114*a*-114*h* into a ground surface. For example, a length of one or more of the traction elements 114*a*-114*h* may taper along a direction from the base portion 132 to the tip portion 134. Particularly at least one of the leading end 136 and the trailing end 138 may be formed at an oblique angle relative to the immediately adjacent surface of the exterior surface 124 of the secondary sole plate 104, whereby the leading end 136 and the trailing end 138 converge with each other along the direction from the exterior surface 124 of the secondary sole plate 104 to the tip portion 134. Here, a relative angle between the leading end 136 and the exterior surface 124 of the secondary sole plate 104 may be less than an angle between the trailing end 138 and the exterior surface 124 of the sole plate 104.

In addition to the tapered length, each traction element 114*a*-114*h* may include a tapering width (i.e., a distance between the first side 140 and the second side 142). For instance, the traction elements 114*a*-114*h* may taper along the direction from the trailing end 138 to the leading end 136. Thus, the width of the traction element 114*a*-114*h* is greater at the trailing end 138 than at the leading end 136. The width of the traction elements 114*a*-114*h* may also taper along the direction from the base portion 132 to the tip portion 134. Accordingly, each of the traction elements 114*a*-114*h* may be described as including a compound taper, whereby the width tapers along the lengthwise direction and the height direction.

Referring now to FIGS. 4A-6, each of the traction elements 116*a*-116*e* includes a substantially similar construction and extends through the exterior surface 124 of the secondary sole plate 104 at different positions. The traction elements 116*a*-116*e* have a conical or frustoconical construction, such that each traction element 116*a*-116*e* tapers in a direction away from the upper 200. Each of the traction elements 116*a*-116*e* includes a height extending from the base portion 130 to a distal tip portion 146 formed at an opposite end of the traction elements 116*a*-116*e* than the base portion 130. As shown and mentioned above, the base portion 130 is defined by the exterior side 120 of the primary sole plate 102 and extends through the secondary sole plate 104. For example, the secondary sole plate 104 defines a series of apertures 148 through which the respective base portions 130 of the traction elements 116*a*-116*e* extend. The apertures 148 may include a perimeter lip 150 that surrounds the base portion 130 of the respective traction element 116*a*-116*e* to define a step configuration between the secondary sole plate 104 and the traction elements 116*a*-116*e*. Providing the apertures 148 with a perimeter lip 150 strengthens the secondary sole plate 104 at the apertures 148 and serves to further support the base portion 130 and the resulting traction element 116*a*-116*e*.

A further step configuration is defined between the base portion 130 and the tip portion 146 when the tip portion 146 is attached to the base portion 130. For example, the tip portion 146 may be separately formed and secondarily attached to the base portion 130. In the illustrated example, the tip portion 146 is separate from the primary sole structure 102 and includes a material that is different than the material of the primary sole structure 102. Namely, the base portion 130 may be integrally formed with the primary sole structure 102 and may be formed from a first material. The tip portion 146 may be formed from a second material different than the first material to provide the traction elements 116*a*-116*e* with an abrasion-resistant distal end that adds to the longevity of the traction elements 116*a*-116*e* and facilitates ground penetration during use. While the tip portion 146 is described and shown as being formed separately from the base portion 130, the tip portion 146 could alternatively be integrally formed with the base portion 130.

Figure 8:
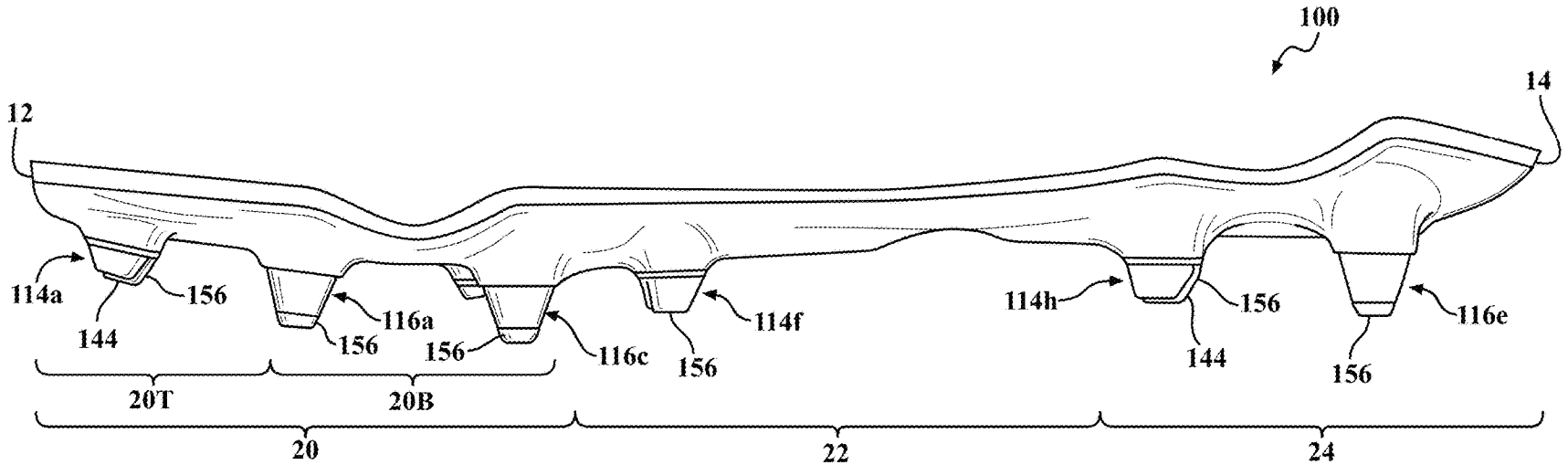
FIG. 8 is a medial side elevation view of the sole structure of FIG. 1.
Figure 9:
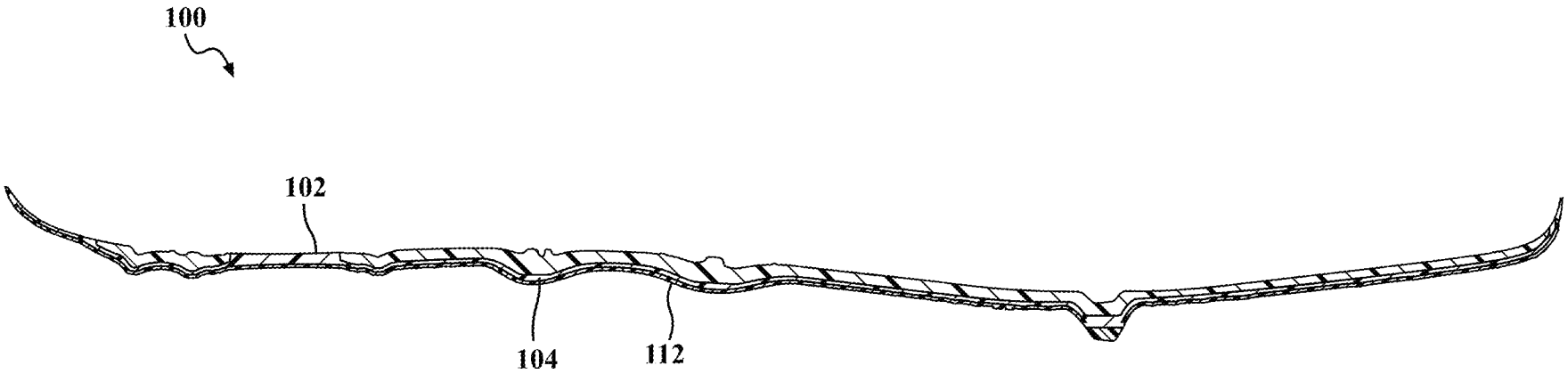
FIG. 9 is a cross-sectional view of the sole structure of FIG. 4A, taken along Line 9-9 of FIG. 4A.
Figure 10:
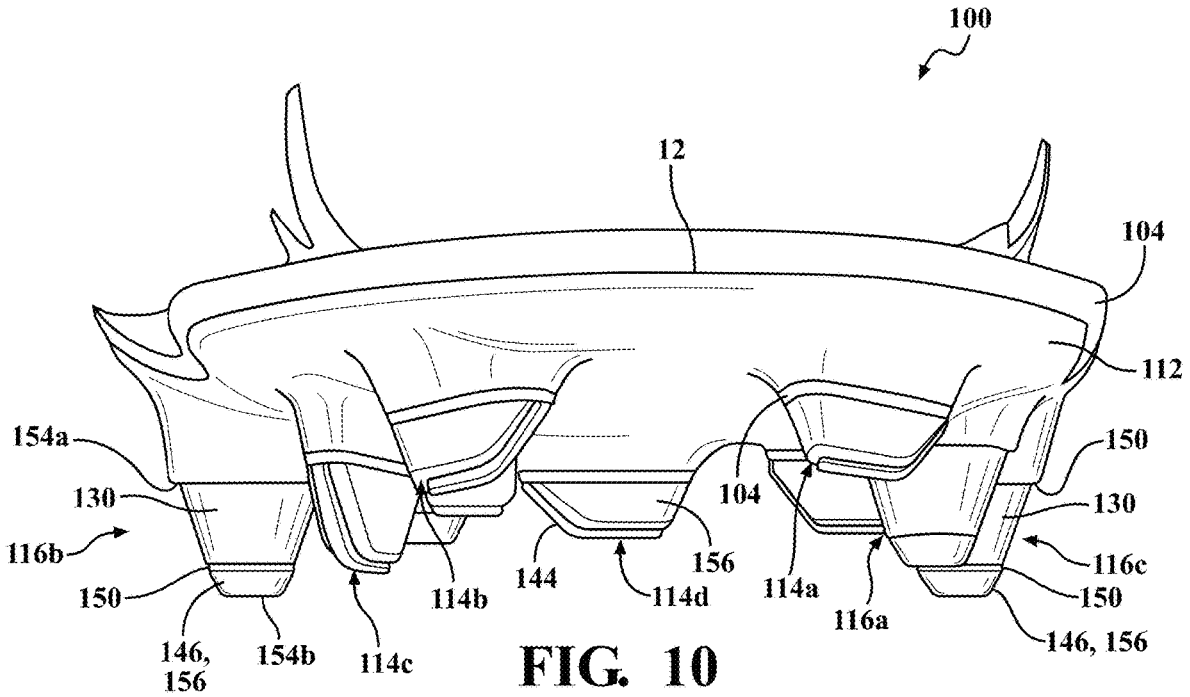
FIG. 10 is a front elevation view of the sole structure of FIG. 1.
Figure 11:
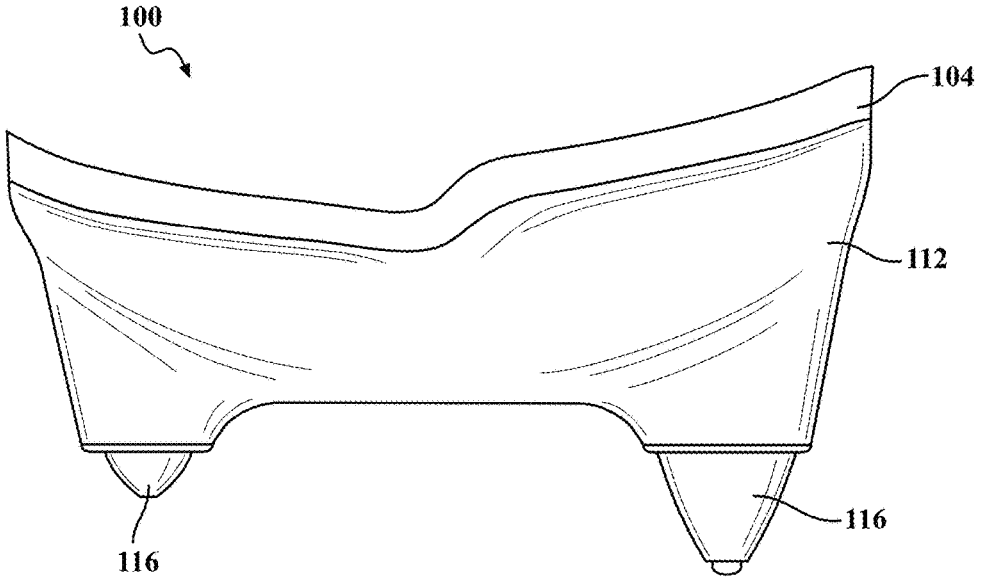
FIG. 11 is a rear elevation view of the sole structure of FIG. 1.
Figure 12:
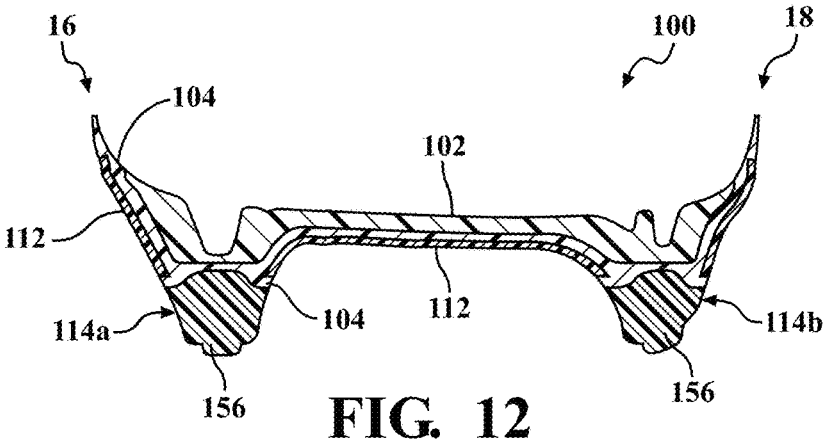
FIG. 12 is a cross-sectional view of the sole structure of FIG. 1, taken along Line 12-12 of FIG. 4A.
Figure 13:
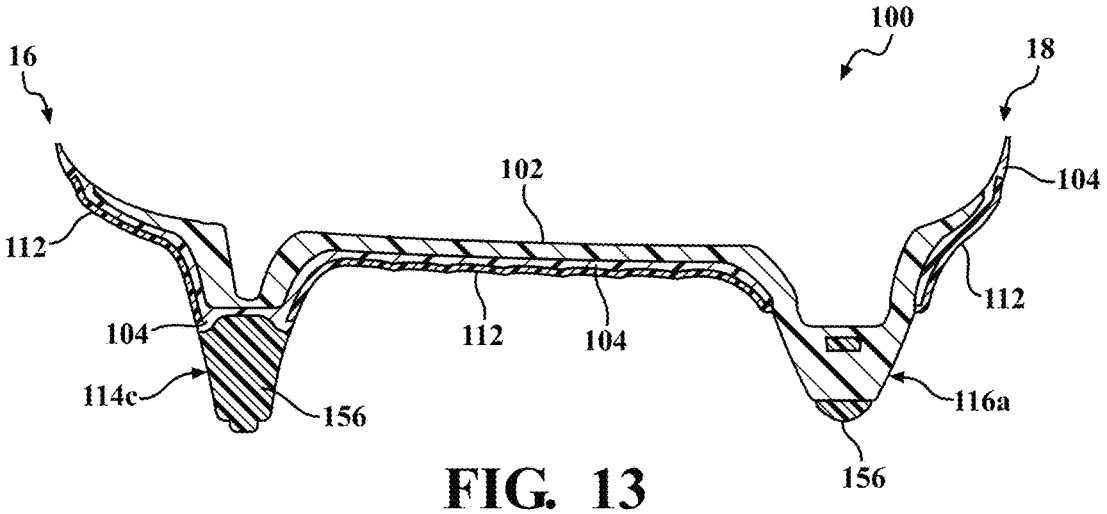
FIG. 13 is a cross-sectional view of the sole structure of FIG. 1, taken along Line 13-13 of FIG. 4A.
Figure 14:
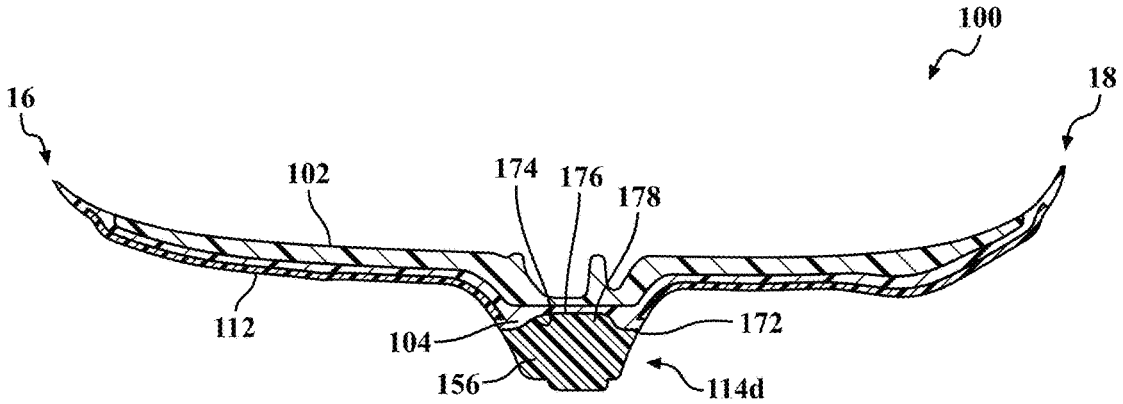
FIG. 14 is a cross-sectional view of the sole structure of FIG. 1, taken along Line 14-14 of FIG. 4A.

As depicted in FIGS. 5 and 8, the traction elements 116*a*-116*e* include a groove 152 located between the base portion 130 and the tip portion 146 as a result of the step configuration. The groove 152 provides the traction elements 116*a*-116*e* with additional structure that aids the traction elements 116*a*-116*e* in engaging and contacting a ground surface. Further, the conical construction of the traction elements 116*a*-116*e* results in the traction elements 116*a*-116*e* tapering from a first end 154*a* to a second end 154*b*. Stated differently, the base portion 130 at the first end 154*a* has a wider construction than the tip portion 146 at the second end 154*b*. Thus, a width of the traction elements 116*a*-116*e* at the first end 154*a* is greater than a width of the traction elements 116*a*-116*e* at the second end 154*b*. The tapered, conical construction of the traction elements 116*a*-116*e* further facilitates penetration of soft ground surfaces via the tip portion 146 and stability around the wider base portion 130.

Figure 15:
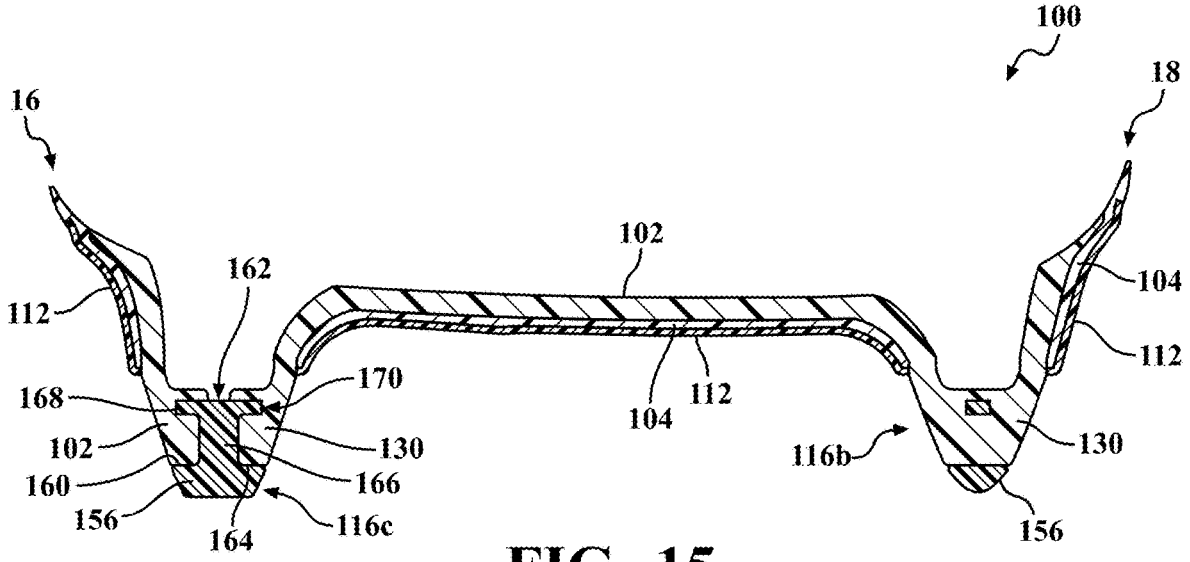
FIG. 15 is a cross-sectional view of the sole structure of FIG. 1, taken along Line 15-15 of FIG. 4A.
Figure 16:
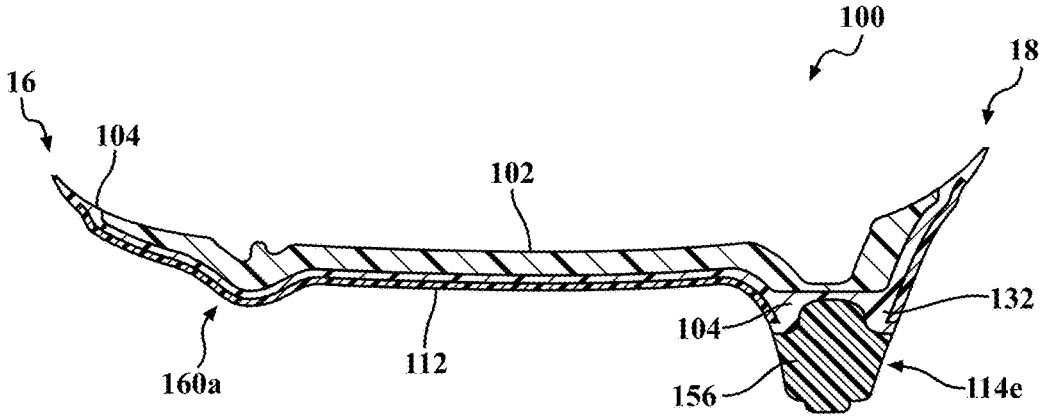
FIG. 16 is a cross-sectional view of the sole structure of FIG. 1, taken along Line 16-16 of FIG. 4A.
Figure 17:
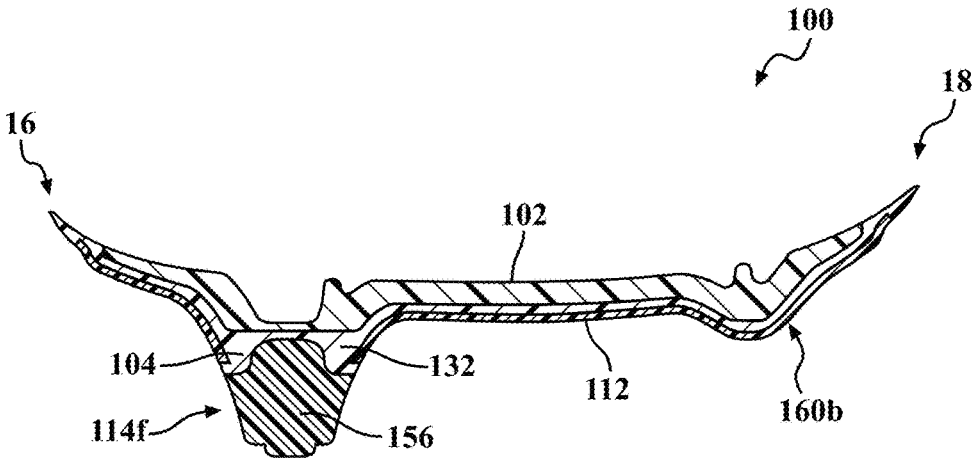
FIG. 17 is a cross-sectional view of the sole structure of FIG. 1, taken along Line 17-17 of FIG. 4A.
Figure 18:
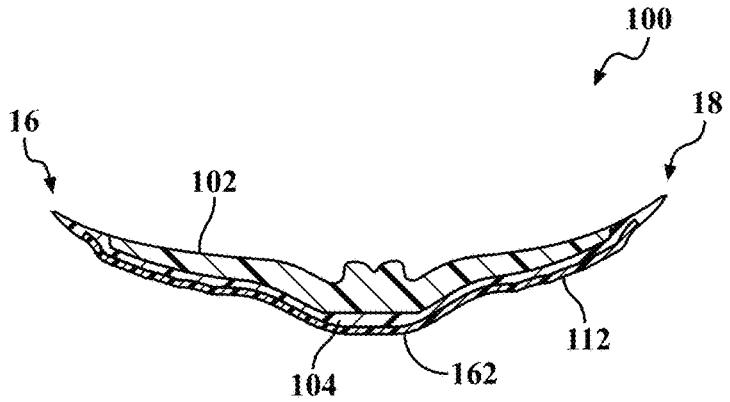
FIG. 18 is a cross-sectional view of the sole structure of FIG. 1, taken along Line 18-18 of FIG. 4A.

With reference now to FIGS. 4A-8 and as generally mentioned above, the traction elements 114*a*-114*h*, 116*a*-116*e* are formed as composite structures, whereby portions of the traction elements 114*a*-114*h*, 116*a*-116*e* are defined by various components and/or materials. For example, the base portion 130 of each traction element 116*a*-116*e* is defined by the primary sole plate 102 and the base portion 132 of each traction element 114*a*-114*h* is defined by the secondary sole plate 104. Comparatively, the tip portions 134, 146 of each traction element 114*a*-114*h*, 116*a*-116*e* is defined by a stud element 156 that is attached to the respective base portion 130, 132. With reference to FIGS. 3 and 15, the base portion 130 of each traction element 116*a*-116*e* is formed on the exterior side 120 of the primary sole plate 102 and extends to a substantially planar lower attachment surface 160. The lower attachment surface 160 may include one or more openings 162. The stud element 156 of the traction elements 116*a*-116*e* includes an upper attachment surface 164 including a shaft 166 received within the opening 162 to provide a mechanical interface for aligning the tip portion 146 (i.e., the stud element 156) and the base portion 130 of the traction element 116. In this example, the attachment interface is provided by a bonding relationship between the attachment surfaces 160, 164 and the shaft 166 within the opening 162. Further, the shaft 166 may include an anchor 168 that is received within a slot 170 of the base portion 130 to securely bond the tip portion 146 with the base portion 130. Bonding may be further strengthened by directly bonding the materials of the stud element 156 and the primary sole plate 102 during a co-molding process or by including an additional adhesive material between the attachment surfaces 160, 164.

Figure 19:
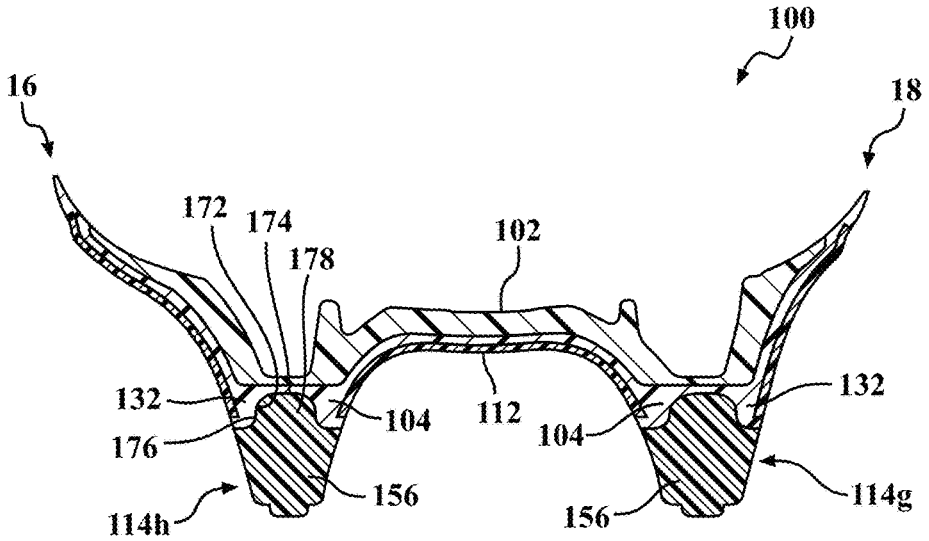
FIG. 19 is a cross-sectional view of the sole structure of FIG. 1, taken along Line 19-19 of FIG. 4A.
Figure 20:
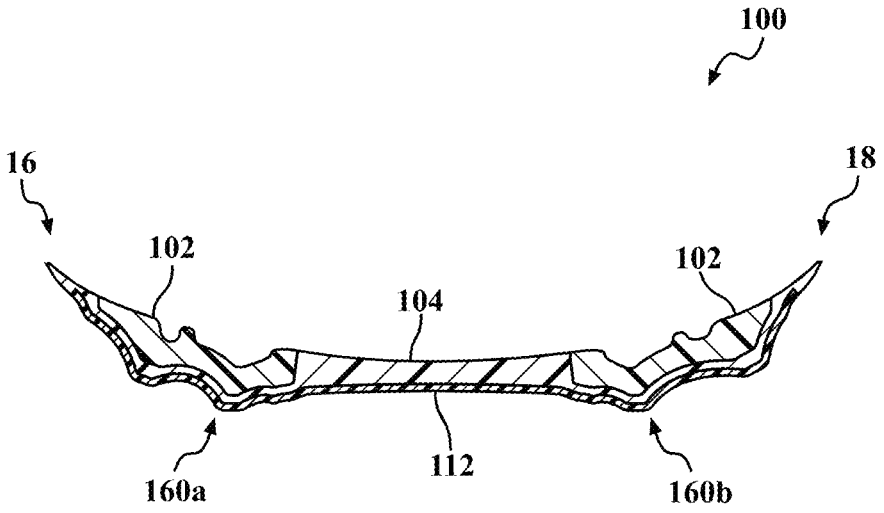
FIG. 20 is a cross-sectional view of the sole structure of FIG. 1, taken along Line 20-20 of FIG. 4A.
Figure 21:
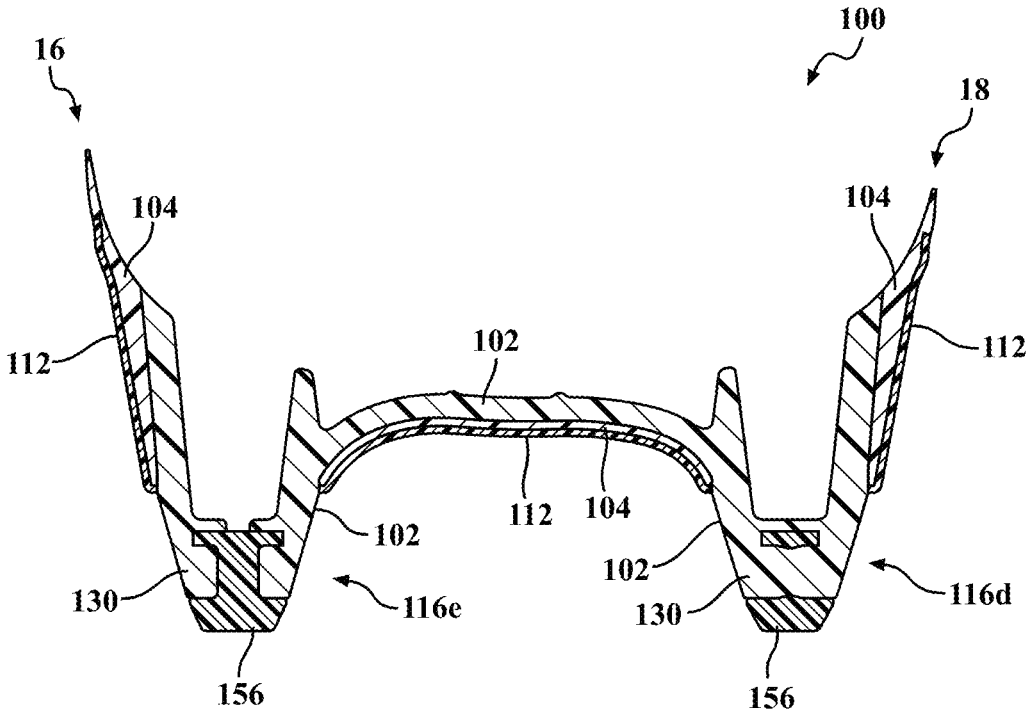
FIG. 21 is a cross-sectional view of the sole structure of FIG. 1, taken along Line 21-21 of FIG. 4A.

With reference to FIGS. 3 and 19, the base portion 132 of each traction element 114*a*-114*h* is defined by the exterior surface 124 of the secondary sole plate 104 and extends to an attachment surface 172. The attachment surface 172 may include a recess 174 that receives an attachment portion 176 of the tip portion 134. The attachment portion 176 of the tip portion 134 includes a protuberance 178 disposed within the recess 174 to provide a mechanical interface for aligning the tip portion 134 (i.e., the stud element 156) and the base portion 132 of the traction element 114. In this example, the attachment interface is provided by a bonding relationship between the attachment surface 172 and the attachment portion 176. Bonding may be accomplished by directly bonding the materials of the stud element 156 and the secondary sole plate 104 during a co-molding process or by including an additional adhesive material between the attachment surface 172 and the attachment portion 176.

As mentioned above and depicted in FIGS. 1 and 2, the traction elements 114*a*-114*h*, 116*a*-116*e* are arranged in groups defining the forefoot cleat set 106, the mid-foot cleat set 108, and the heel cleat set 110. Generally, the traction elements 114*a*-114*h*, 116*a*-116*e* are positioned and oriented to provide each cleat set 106, 108, 110 with a unique function associated with the respective region of the sole structure 100.

For example, the forefoot cleat set 106 includes a first plurality of conical traction elements 116*a*-116*c* and the heel cleat set 110 includes a second plurality of conical traction elements 116*d*, 116*e*. The conical traction elements 116*a*-116*c* of the forefoot cleat set 106 include two traction elements 116*a*, 116*c* extending along the medial side 16 of the sole structure 100 and a traction element 116*b* extending along the lateral side of the sole structure 100. The traction element 116*c* is substantially aligned with the traction element 116*b* across a width of the sole structure 100 and cooperate to provide the sole structure with traction during forward movements such as running and walking. The traction element 116*a* is disposed between the traction element 116*c* and the anterior end 12 of the sole structure 100 and is surrounded by a series of traction elements 114*a*-114*d*. As will be described in more detail below, the traction elements 114*a*-114*d* are arranged in a circular pattern (FIG. 4B) and the traction element 116*a* is located substantially within an imaginary circle defined by the traction elements 114*a*-114*d*. This arrangement allows the traction elements 114*a*-114*d* to penetrate a ground surface and provide support during pivoting movements. Further, providing the traction element 116*a* with a conical shape allows the traction element 116*a* to similarly provide traction during a pivoting movement. In one configuration, the traction element 116*a* may penetrate a ground surface and act as an anchor during a pivoting movement about the traction element 116*a*. Namely, as the sole structure 100 is pivoted about the traction element 116*a*, the traction elements 114*a*-114*d* may pivot in a direction around the circular pattern defined by the relative relationship between the traction elements 114*a*-114*d*.

The traction elements 116*d*, 116*e* of the heel cleat set 110 are located adjacent to the posterior end 14 of the sole structure 100 with the traction element 116*d* being located proximate to the medial side 16 of the sole structure 100 and the traction element 116*e* being located proximate to the lateral side 18 of the sole structure 100. In one configuration, the traction element 116*d* is aligned with the traction element 116*e* across a width of the sole structure in a similar fashion as the traction elements 116*b*, 116*c*. The traction elements 116*d*, 116*e* serve to penetrate a ground surface during wear when an athlete needs to plant or stop a forward movement. For example, an athlete may engage one or more of the traction elements 116*d*, 116*e* with a ground surface when stopping to kick a ball or change directions. While the traction elements 116*b*, 116*c* are described as being aligned with one another across a width of the sole structure 100 and the traction elements 116*d*, 116*e* are described as being aligned with one another across a width of the sole structure 100, the traction element 116*b* may be disposed closer to the posterior end 14 of the sole structure 100 than the traction element 116*c* and/or the traction element 116*d* may be disposed closer to the posterior end 14 of the sole structure 100 than the traction element 116*e*.

The tapered construction of the traction elements 116*a*-116*e* penetrates soft ground surfaces to a greater degree as compared to the elongate traction elements 114*a*-114*h*. Accordingly, the traction elements 116*a*-116*e* are positioned at locations of the sole structure 100 where ground penetration during use is important (i.e., during stopping movements or during forward running and/or walking movements), as described above.

Figure 4B:
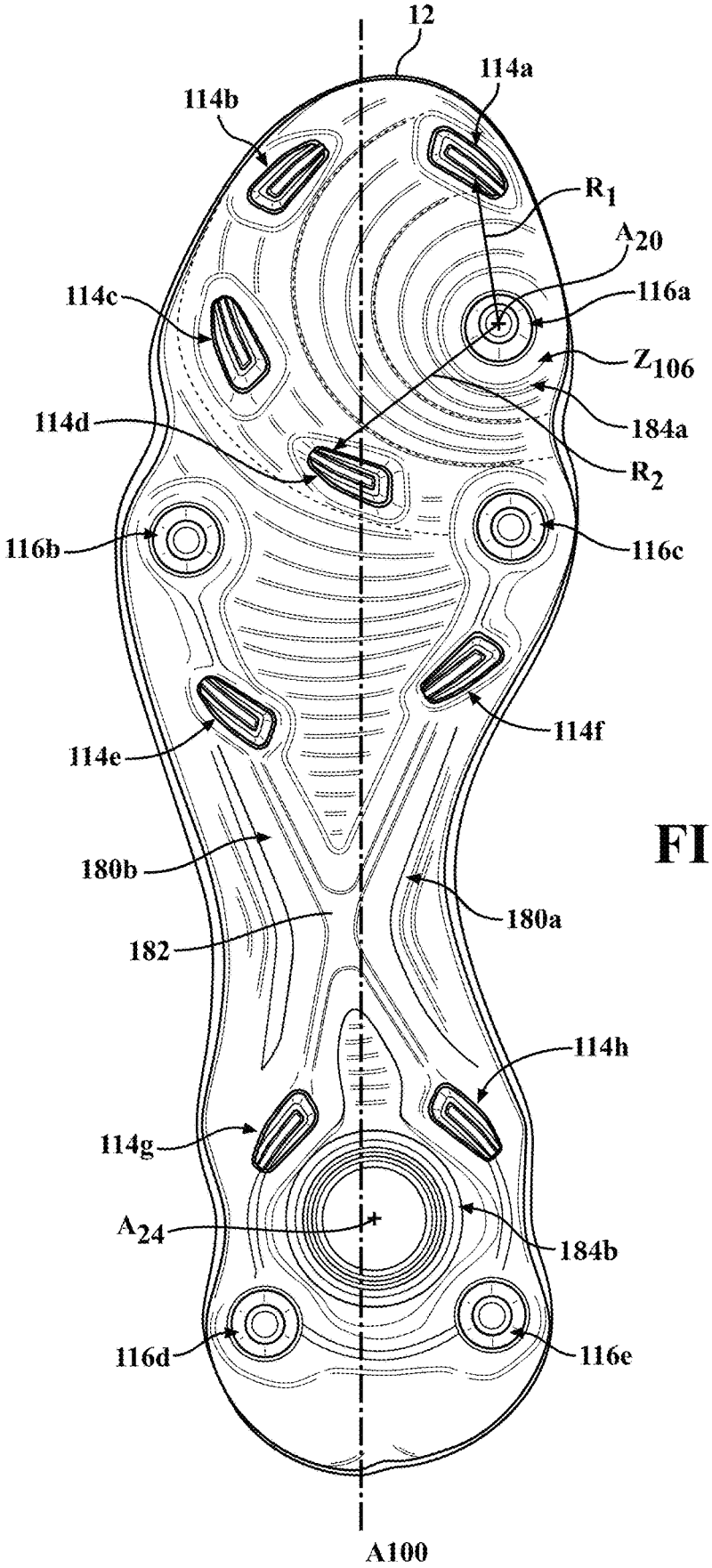
FIG. 4B is a bottom plan view of the sole structure of FIG. 1.

As depicted in FIG. 4B, elongate traction elements 114*a*-114*d* are arranged and oriented in an arcuate or radial pattern with respect to a forefoot rotational axis $A_{20}$. The forefoot rotational axis $A_{20}$ is centrally defined by the traction element 116*a* disposed on the medial side 16 of the sole structure 100. The traction elements 114*a*-114*d* are arranged in the arcuate pattern within a forefoot rotational zone $Z_{106}$ defined between a first radius R1 and a second radius R2. Stated differently, the traction elements 114*a*-114*d* are oriented in a rotational direction about the traction element 116*a*. The traction element 116*a* may be defined as a pivot point of the forefoot cleat set 106, such that the rotational zone $Z_{106}$ radiates from the forefoot rotational axis $A_{20}$ at the traction element 116*a*. As illustrated in FIG. 4B, the traction element 114*a* is positioned within the first radius R1 from the traction element 116*a* and the traction element 114*d* is positioned within the second radius R2 from the traction element 116*a*. Given the elongate, compound taper of the traction elements 114*a*-114*d* and the rotational orientation, the traction elements 114*a*-114*d* may provide traction and rotation about the pivot point defined by the deep ground penetration of the traction element 116*a*. As shown in FIG. 4B, the traction element 114*a* is located closer to the traction element 116*a* than the traction element 114*d*, as R1 is less than R2. Similarly, the traction element 114*a* may be located closer to the traction element 116*a* than the traction elements 114*b*, 114*c*, which may be located a distance from the traction element 116*a* that is equal to or greater than R2. In any event, the traction element 114*a* is located closer to the traction element 116*a* than any of the traction elements 114*b*-114*d* and is located closer to the anterior end 12 than any of the traction elements 114*b*-114*d*, 116*a*.

The traction element 114*d* is positioned adjacent to the traction element 116*c* such that the trailing end 138 of the traction element 114*d* opposes the traction element 116*c*. Further, the traction element 116*c* is aligned with the traction element 114*d* along the curvature defined by the traction elements 114*a*-114*d*. As shown in FIG. 4B, the traction element 116 is disposed closer to the posterior end 14 than any of the traction elements 114*a*-114*d*, 116*a*.

With continued reference to FIG. 4B, the heel cleat set 110 is arranged in the heel region 24 of the sole structure. While the heel cleat set 110 includes a second plurality of traction elements 114*g*, 114*h* arranged in a generally annular pattern, the heel cleat set 110 is configured in an anti-rotational manner. Particularly, the heel cleat set 110 includes at least one traction element 114*g*, 114*h* oriented in a first rotational direction (e.g., clockwise) about a heel rotational axis $A_{24}$ and at least one traction element 114*g*, 114*h* oriented in an opposite second rotational direction (e.g. counter-clockwise) about the heel rotational axis $A_{24}$. Thus, the heel cleat set 110 is configured to provide relatively high lateral and longitudinal traction while providing similar resistance to rotation in the clockwise and counter-clockwise directions. The traction is further facilitated by the traction elements 116*d*, 116*e*, with one of the traction elements 116*d*, 116*e* diametrically opposed to a second one of the traction elements 116*d*, 116*e* across the heel rotational axis $A_{24}$. Stated differently, the traction elements 116*d*, 116*e* are positioned in a generally linear orientation proximate the anterior end 12 of the sole structure 100 to facilitate deep ground penetration and braking.

As shown in FIG. 4B, trailing ends 138 of the traction elements 114*h*, 114*g* oppose one another along a radius of curvature defined by the traction elements 114*h*, 114*g*. Further, the traction elements 116*d*, 116*e* may be disposed along the radius of curvature defied by the traction elements 114*h*, 114*g*.

In the illustrated example, the heel cleat set 110 includes an anterior-medial heel traction element 114*h*, an anterior-lateral heel traction element 114*g*, a posterior-medial heel traction element 116*e*, and a posterior-lateral heel traction element 116*d*. For the sake of description, the respective pairs of the traction elements 114*g*, 114*h*, 116*d*, 116*e* of the heel cleat set 110 may be referred as anterior heel traction elements 114*g*, 114*h*, posterior heel traction elements 116*d*, 116*e*, medial heel traction elements 114*h*, 116*e*, or lateral heel traction elements 114*g*, 116*d*. In the illustrated example, one of the anterior heel traction elements 114*g*, 114*h* are oriented in the opposite rotational direction from the other one of the anterior traction elements 114*g*, 114*h*. For example, the anterior-medial heel traction element 114*h* is oriented in an opposite rotational direction from the anterior-lateral heel traction element 114*g* (anterior pair).

Referring generally to FIGS. 1-21, the primary sole plate 102 and the secondary sole plate 104 each includes various structural features to promote desired torsional and stiffness properties. In the illustrated example, the sole plates 102, 104 include a pair of ribs 180*a*, 180*b* extending between the mid-foot cleat set 108 and the heel cleat set 110. Particularly, a first one of the ribs 180*a* extends between and connects a base portion 132 of the medial mid-foot traction element 114*f* and a base portion 132 of the anterior-lateral heel traction element 114*g*. Similarly, a second one of the ribs 180*b* extends between and connects a base portion 132 of the lateral mid-foot traction element 114*e* and a base portion 132 of the anterior-medial heel traction element 114*h*. As shown, the ribs 180*a*, 180*b* are integrally and continuously formed with the base portions 132 of the traction elements 114*e*-114*h*. The ribs 180*a*, 180*b* intersect each other at junction 182 at an intermediate portion of the mid-foot region 22. The junction 182 is substantially centered between opposing portions of the peripheral edge 126 in the mid-foot region 22 and, further, is longitudinally aligned with a narrowest portion of the secondary sole plate 104.

The secondary sole plate 104 may further include one or more annular ribs 184*a* formed in the forefoot region 20 within the forefoot cleat set 106 and one or more annular ribs 184*b* formed in the heel region 24 within the heel cleat set 110. The annular ribs 184*a*, 184*b* protrude from the exterior side 120 and may define a cavity in the heel region 24 between the traction elements 114*g*-114*h*, 116*d*-116*e* of the heel cleat set 110. In the illustrated example, the annular ribs 184*b* are circular (i.e., constant radius) and include a primary annular rib 184*b* and a pair of secondary annular ribs 184*b* having a smaller radius and height than the primary rib 184*b*. The annular ribs 184*a* of the forefoot region 20 radiate from the traction element 116*a* in an arcuate configuration. The annular ribs 184*a* extend in length as the annular ribs 184*a* radiate from the traction element 116*a*. For example, the annular ribs 184*a* proximate to the first radius R1 each have a length that is less than the length of the annular ribs 184*a* proximate to the second radius R2.

The ribs 180*a*, 180*b*, 184*b* are also formed as shell structures that protrude from the exterior side 120 of the primary sole plate 102 (FIG. 3) and define corresponding recesses on the opposite interior side 118 of the primary sole plate 102 (FIG. 4A). As best shown in FIG. 4A, the ribs 180*a*, 180*b*, 184*b* and the traction elements 114*a*-114*h*, 116*a*-116*e* may include interior torsion elements 186*a*, 186*b* formed within the recesses on the interior side 118. In the illustrated example, the torsion elements 186*a*, 186*b* include braces 186*a*, 186*b* extending across the recesses. The braces 186*a*, 186*b* are generally aligned along the lengths of the longitudinal ribs 180*a*, 180*b* and are arranged as a radial array of helical braces 186*b* about the heel rotational axis $A_{24}$ (FIG. 4B) within the heel region 24.

The sole structure 100 is constructed such that the primary sole plate 102 includes a first material having a greater stiffness than the materials forming the secondary sole plate 104 and the traction elements 114*a*-114*h*. For example, suitable materials for the primary sole plate 102 include a fiberglass reinforced polyamide material (e.g., Rilsan™ BZM materials produced by Arkema™). Suitable materials for the secondary sole plate 104 may include, but are not limited to, thermoplastic elastomer resins (e.g., Pebax® Rnew® materials produced by Arkema™). The film layer 112, as mentioned above, functions as an anti-clog film that is applied to the secondary sole plate 104. Suitable materials for the stud elements 156 of the traction elements 114*a*-114*h* include, but are not limited to, thermoplastic polyurethanes (TPUs), polyolefins, polyolefin based elastomers, and nylons, as these materials provide superior abrasion properties. The stud elements 156 of the traction elements 116*a*-116*e* may be constructed from a material having a greater stiffness than the materials forming the primary and secondary sole plates 102, 104 and stud elements 156 of the traction elements 114*a*-114*h*. Namely, the material of the stud elements 156 of the conical traction elements 116*a*-116*e* may be different than the material of the stud elements 156 of the elongate traction elements 114*a*-114*h*. For example, the stud elements 156 of the traction elements 116*a*-116*e* may be formed from metal.

Referring again to FIG. 1, the upper 200 may be formed from one or more materials that are stitched or adhesively bonded together to define the interior void. Suitable materials of the upper 200 may include, but are not limited to, textiles, foam, leather, and synthetic leather. The example upper 200 may be formed from a combination of one or more substantially inelastic or non-stretchable materials and one or more substantially elastic or stretchable materials disposed in different regions of the upper 200 to facilitate movement of the article of footwear 10 between a tightened state and a loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

The following Clauses provide an exemplary configuration for a sole structure for an article of footwear, an article of footwear, and a composite structure described above.

Clause 1: A sole structure for an article of footwear, the sole structure comprising a first conical traction element disposed in a forefoot region of the sole structure; and a first elongate traction element, a second elongate traction element, and a third elongate traction element arranged in a radial pattern around the first conical traction element within the forefoot region.

Clause 2: The sole structure of Clause 1, wherein the first conical traction element is frustoconical.

Clause 3: The sole structure of any of the preceding Clauses, wherein each of the first elongate traction element, the second elongate traction element, and the third elongate traction element includes a trailing end that tapers down to a leading end.

Clause 4: The sole structure of Clause 3, wherein the second elongate traction element is disposed between the first elongate traction element and the third elongate traction element, the leading end of the second elongate traction element opposing the trailing end of the first elongate traction element and the trailing end of the second elongate traction element opposing the leading end of the third elongate traction element.

Clause 5: The sole structure of any of the preceding Clauses, wherein at least one of the first elongate traction element, the second elongate traction element, and the third elongate traction element is disposed a different distance from the first conical traction element than the others of the first elongate traction element, the second elongate traction element, and the third elongate traction element.

Clause 6: The sole structure of any of the preceding Clauses, wherein the first conical traction element is disposed adjacent to a medial side of the sole structure.

Clause 7: The sole structure of Clause 6, further comprising a second conical traction element disposed adjacent to the medial side of the sole structure and between the first conical traction element and a posterior end of the sole structure.

Clause 8: The sole structure of Clause 7, wherein one of the first elongate traction element, the second elongate traction element, and the third elongate traction element is aligned with the second conical traction element.

Clause 9: The sole structure of Clause 8, wherein the second conical traction element is disposed closer to a posterior end of the sole structure than the one of the first elongate traction element, the second elongate traction element, and the third elongate traction element.

Clause 10: An article of footwear incorporating the sole structure of any of the preceding Clauses.

Clause 11: A sole structure for an article of footwear, the sole structure comprising a first conical traction element disposed in a heel region of the sole structure and adjacent to a medial side of the sole structure; a second conical traction element disposed in the heel region of the sole structure and adjacent to a lateral side of the sole structure; a first elongate traction element disposed in the heel region of the sole structure and proximate to the medial side of the sole structure; and a second elongate traction element disposed in the heel region of the sole structure and proximate to the lateral side of the sole structure, the first conical traction element, the second conical traction element, the first elongate traction element, and the second elongate traction element disposed in a radial pattern.

Clause 12: The sole structure of Clause 11, wherein at least one of the first conical traction element and the second conical traction element is frustoconical.

Clause 13: The sole structure of any of the preceding Clauses, wherein each of the first elongate traction element and the second elongate traction element includes a trailing end that tapers down to a leading end.

Clause 14: The sole structure of Clause 13, wherein the leading end of the first elongate traction element opposes the first conical traction element.

Clause 15: The sole structure of Clause 14, wherein the leading end of the second elongate traction element opposes the second conical traction element.

Clause 16: The sole structure of Clause 15, wherein the trailing end of the first elongate traction element opposes the trailing end of the second elongate traction element.

Clause 17: The sole structure of Clause 13, wherein the trailing end of the first elongate traction element opposes the trailing end of the second elongate traction element.

Clause 18: The sole structure of any of the preceding Clauses, further comprising a plate defining a ground-engaging surface of the sole structure.

Clause 19: The sole structure of Clause 18, wherein at least a portion of the first conical traction element, the second conical traction element, the first elongate traction element, and the second elongate traction element is integrally formed with the plate.

Clause 20: An article of footwear incorporating the sole structure of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a plurality of conical traction elements including a first conical traction element, a second conical traction element, and a third conical traction element each disposed in a forefoot region of the sole structure; and a first elongate traction element, a second elongate traction element, and a third elongate traction element arranged within the forefoot region in an arcuate pattern around the first conical traction element that is continuous and uninterrupted by any of the plurality of conical traction elements.

2. The sole structure of claim 1, wherein the first conical traction element is frustoconical.

3. The sole structure of claim 1, wherein each of the first elongate traction element, the second elongate traction element, and the third elongate traction element includes a trailing end that tapers down to a leading end.

4. The sole structure of claim 3, wherein the second elongate traction element is disposed between the first elongate traction element and the third elongate traction element, the leading end of the second elongate traction element opposing the trailing end of the first elongate traction element and the trailing end of the second elongate traction element opposing the leading end of the third elongate traction element.

5. The sole structure of claim 1, wherein at least one of the first elongate traction element, the second elongate traction element, and the third elongate traction element is disposed a different distance from the first conical traction element than the others of the first elongate traction element, the second elongate traction element, and the third elongate traction element.

6. The sole structure of claim 1, wherein the first conical traction element is disposed adjacent to a medial side of the sole structure.

7. The sole structure of claim 6, wherein the second conical traction element is disposed adjacent to the medial side of the sole structure and between the first conical traction element and a posterior end of the sole structure.

8. The sole structure of claim 7, wherein one of the first elongate traction element, the second elongate traction element, and the third elongate traction element is aligned with the second conical traction element.

9. The sole structure of claim 8, wherein the second conical traction element is disposed closer to a posterior end of the sole structure than the one of the first elongate traction element, the second elongate traction element, and the third elongate traction element.

10. An article of footwear incorporating the sole structure of claim 1.

11. A sole structure for an article of footwear, the sole structure comprising:

a first elongate traction element disposed in a heel region of the sole structure proximate to a medial side of the sole structure and oriented in a first rotational direction about a central axis of the heel region;

a second elongate traction element disposed in the heel region of the sole structure proximate to a lateral side of the sole structure and oriented in a second rotational direction about the central axis of the heel region to define a radius of curvature with the first elongate traction element;

a first conical traction element disposed in the heel region of the sole structure proximate to the medial side of the sole structure and disposed along the radius of curvature; and a second conical traction element disposed in the heel region of the sole structure proximate to a lateral side of the sole structure and disposed along the radius of curvature.

12. The sole structure of claim 11, wherein at least one of the first conical traction element and the second conical traction element is frustoconical.

13. The sole structure of claim 11, wherein each of the first elongate traction element and the second elongate traction element includes a trailing end that tapers down to a leading end.

14. The sole structure of claim 13, wherein the leading end of the first elongate traction element opposes the first conical traction element.

15. The sole structure of claim 14, wherein the leading end of the second elongate traction element opposes the second conical traction element.

16. The sole structure of claim 15, wherein the trailing end of the first elongate traction element opposes the trailing end of the second elongate traction element.

17. The sole structure of claim 13, wherein the trailing end of the first elongate traction element opposes the trailing end of the second elongate traction element.

18. The sole structure of claim 11, further comprising a plate defining a ground-engaging surface of the sole structure.

19. The sole structure of claim 18, wherein at least a portion of the first conical traction element, the second conical traction element, the first elongate traction element, and the second elongate traction element is integrally formed with the plate.

20. An article of footwear incorporating the sole structure of claim 11.

* * * * *